United States Patent [19]

Phelps

[11] 3,997,219

[45] Dec. 14, 1976

[54] JEWELRY CABINET

[76] Inventor: Gary M. Phelps, 1211 E. Vine, West Covina, Calif. 91791

[22] Filed: July 17, 1975

[21] Appl. No.: 596,654

[52] U.S. Cl. ..... 312/234; 312/245; 312/324

[51] Int. Cl.[2] ..... A47B 67/02

[58] Field of Search ..... 312/DIG. 33, 117, 118, 312/126, 202, 138, 234, 245, 322, 324, 327, 328

[56] References Cited

UNITED STATES PATENTS

| | | | |
|---|---|---|---|
| 3,070,235 | 12/1962 | Manzardo | 312/234 |
| 3,347,187 | 10/1967 | Khoury | 312/245 |
| 3,753,606 | 8/1973 | Ozeki | 312/223 |
| 3,822,925 | 7/1974 | Osroff | 312/138 A |

FOREIGN PATENTS OR APPLICATIONS

| | | | |
|---|---|---|---|
| 1,112,555 | 3/1956 | France | 312/324 |

*Primary Examiner*—Casmir A. Nunberg
*Attorney, Agent, or Firm*—Donald D. Mon; D. Gordon Angus

[57] ABSTRACT

A jewelry display cabinet adapted to be placed upon a table, has a base, a roof and vertical side walls and is open at the front except for a transparent swinging door or doors. The panel of the door or doors is provided with vertically spaced shelves attached to the rear surface of each door and there is attached at the rear edge of each shelf a strip which depends below the shelf and extends somewhat above the shelf. The lower edges of these vertical strips are provided with inverted V-shaped slots so that items of jewelry may be inserted into the slots and hang therefrom below the respective strips. Other jewelry may be placed upon the shelves.

4 Claims, 5 Drawing Figures

JEWELRY CABINET

This invention relates to cabinet means for storing jewelry when it is not in use, in a manner making it clearly visible.

An object is to provide a cabinet structure for storage which can visibly display the items of jewelry. A related object is to facilitate the supporting of the jewelry in the storage cabinet.

The invention is carried out by provision of a cabinet having a base which can be rested on a table or the like, which is open at the front except for the provision of a pivotable panel means which should be transparent if jewelry within it is to be displayed from outside through the panel. In one embodiment the panel means comprises a pair of pivotable panels, and in another embodiment the panel means comprises a single pivotable panel.

The panel means is provided with spaced shelves at its inner surface, on which jewelry can be rested, and at the back of each shelf there is attached a strip which extends vertically downward, the lower edge of which is slotted to form inverted V's into which items of jewelry may be placed to hang from these strips. Preferably also, the strips extend upward above the level of the shelves for some distance to prevent items of jewelry from falling off the shelves.

The foregoing and other features of the invention will be better understood from the following detailed description and the accompanying drawings of which:

Figure 1:
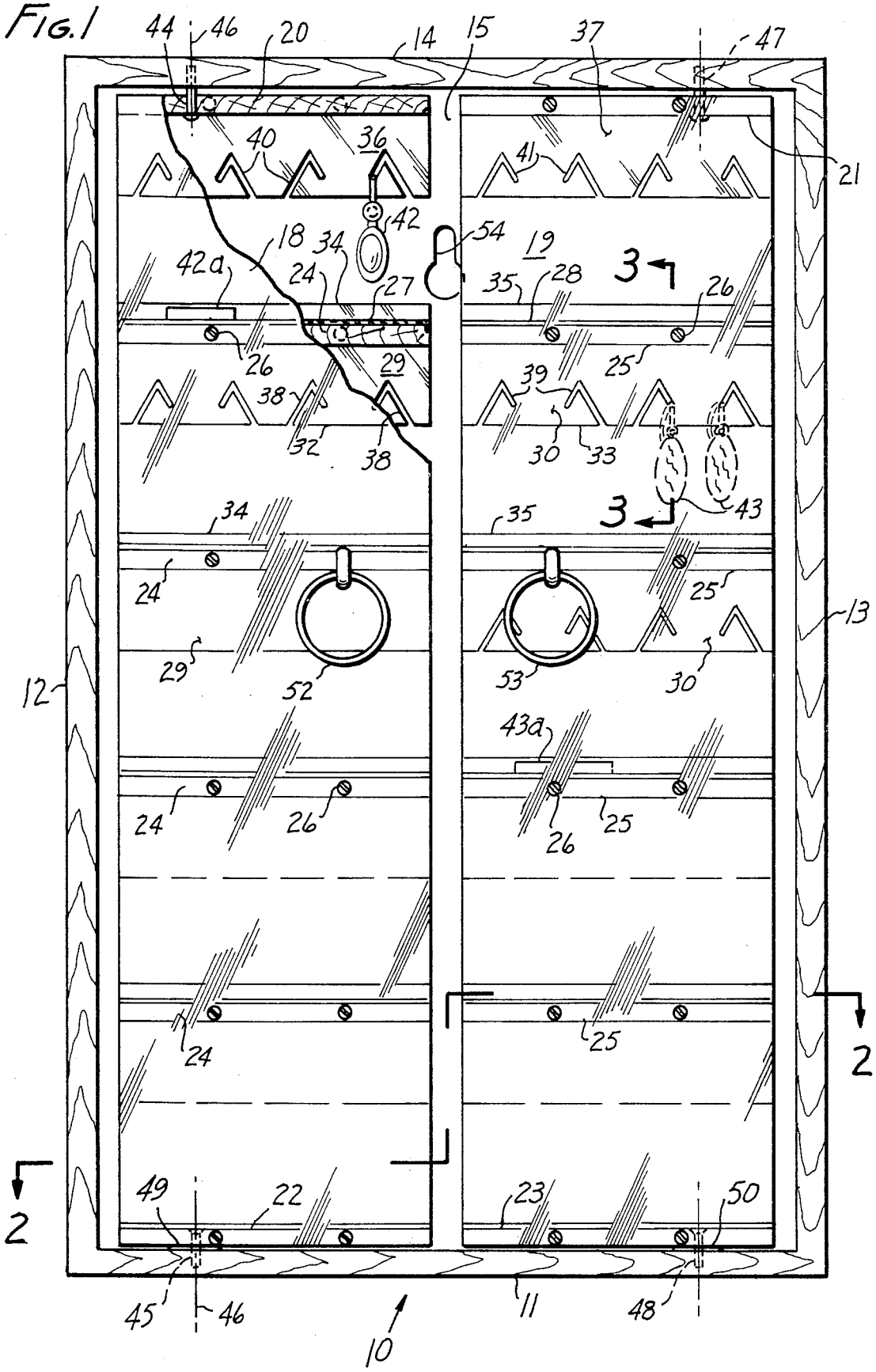
FIG. 1 is an elevation view, partly broken away, showing a jewelry storage and display means according to this invention.
Figure 2:
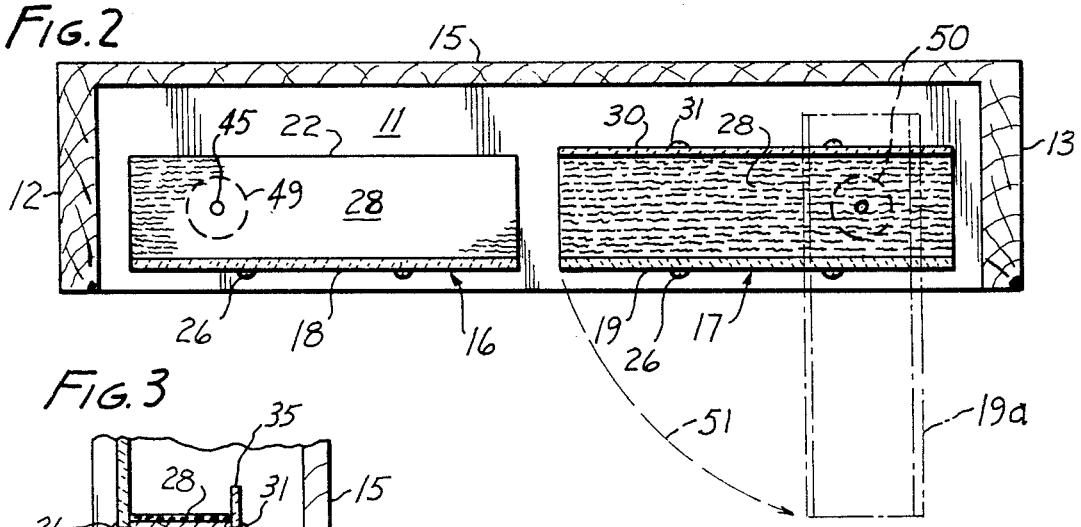
FIG. 2 is a cross-section view taken at line 2—2 of FIG. 1.
Figure 3:
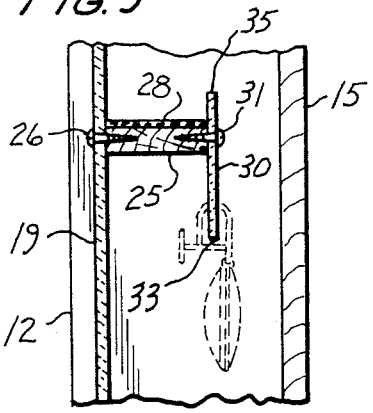
FIG. 3 is a cross-section view of a detail taken at line 3—3 of FIG. 1.

Referring to FIGS. 1, 2 and 3, there is shown a jewelry cabinet 10 having a horizontal base 11 from the ends of which there extend vertical side walls 12 and 13, and a horizontal top member 14 extending between the upper ends of the side walls. The back of the rectangular frame formed by members 11, 12, 13 and 14 is covered by a back member 15. The front of this rectangular frame is left uncovered and hence the front of the cabinet is open except as closure is provided by doors 16 and 17.

Each of doors 16 and 17 comprises a rectangular panel 18 and 19 of transparent material which may be plastic, having a length almost, but not quite, equal to the distance between the upper surface of base 11 and the lower surface of top member 14 so that the transparent sheets fit between the base and the top with some clearance. The widths of the transparent panels are equal and such that there is sufficient clearance between them and from the side members 12 and 13 of the cabinet that when the panels are placed as a cover for the open front of the cabinet as shown in FIGS. 1 and 2, there will be some clearance between the juxtaposed side edges of the panels and also between each remaining side edge and the adjacent side wall of the cabinet, for reasons explained below.

At the rear surfaces at their top horizontal edges the transparent panels 18 and 19 have attached to them strips 20 and 21, respectively, and strips 22 and 23 are attached to the rear surface at the lower horizontal edges of these respective panels. At the rear surfaces of the two transparent panels there are also attached a number of horizontal shelves 24 and 25, respectively, spaced vertically from each other, these shelves being in the form of strips similar in dimension to the upper and lower strips 20, 21, 22 and 23. All of these strips are attached to the transparent panels by suitable fasteners such as screws 26 passing from the front surfaces through the panels to the forward edges of the strips. The shelves 24 and 25 are spaced equi-distant apart and also the spacing of the upper shelves 24 and 25 from the upper strips 20 and 21 and the spacing between the lower shelves 24 and 25 and the lower strips 22 and 23 are likewise the same as the spacing between respective shelves 24 and 25. It should be understood, however, that this equal spacing is not essential, as some other spacing may be selected if desired. The upper surfaces of each of the shelves 24 and 25, and also the upper surfaces of strips 22 and 23, which may act as shelves, are covered by strips 27 and 28 of a suitable carpeting material which may be felt or the like, attached to these upper surfaces in any suitable manner such as glue.

Strips of sheet material 29 and 30, preferably transparent, are attached to the rear edges of the respective shelves 24 and 25. These strips are fastened by suitable fasteners such as screws 31 passing through the strips and into the shelf, so that the strips lie in a vertical plane. The lower horizontal edges 32 and 33 of these strips extend for some distance below their respective shelves and the upper horizontal edges 34 and 35 of these strips extend a significant distance above the shelf and the carpeting material on the shelf.

Strips of transparent sheet material 36 and 37 are attached to the rear edges of upper strips 20 and 21 in a manner similar to the attachment of strips 29 and 39 to their respective shelves. Strips 36 and 37 have dimensions similar to those of strips 32 and 33 except that they do not extend above the upper surfaces of strips 20 and 21.

The portions of strips 29 and 30 which extend below their respective shelves are provided with slots 38 and 39, respectively, in the shape of inverted V's, one leg of each V commencing at the lower edge of the respective strip and the other leg of each V being shorter than the first-mentioned leg so that said other leg does not extend down as far as the edge of the strip. Slots 40 and 41 of the same size and shape as slots 38 and 39 are formed at the lower portions of strips 36 and 37. The widths of all these slots are preferably the same, although it will be understood that there may be some differences among them and they are sufficiently wide to accommodate pieces of jewelry indicated by the earrings 42 and 43. It will be understood, of course, that other pieces of jewelry or decorative items such as pendants, bracelets and the like may be hung at the slots in the same manner. As is shown in the drawing, a part of the jewelry or other item is inserted through the longer leg of the V slot so that it drops down to the end of the shorter leg for suspension. Jewelry may also be placed on the shelves as shown at 42*a* and 43*a*.

The uppermost and lowermost strips 20 and 22 of transparent panel 18 are provided with pivot pins 44 and 45, respectively. These two pins are vertically aligned with each other, the pin 44 passing through its strip 20 into the top member 14 of the cabinet and the lower pin 45 extending downward into the base 11 of the cabinet. The vertical center line 46 passing longitudinally through these two pivot pins is offset toward side member 12 of the cabinet relative to the vertical center of panel 18. The other panel 19 is similarly provided with vertically aligned pivot pins 47 and 48 offset toward the other side cabinet member 13 relative to the vertical center line of the panel 19.

It is thus seen that the transparent panels 18 and 19 with their strips and shelves function as swinging doors which pivot on the axes of their respective pins.

The pins 45 and 48 pass through thrust washers 49 and 50 respectively, placed between the lower strips 22 and 23 and the base member 11 so that the weight of the transparent panels 18 and 19 and their shelves and strips is taken by these thrust washers.

The swinging of the panels at their pins is illustrated in FIG. 2 by the position of panel 19 which is shown in broken lines at 19*a* after having swung open as indicated by curved arrow 51. Handles 52 and 53 attached to the panels at respective ones of the shelves facilitates swinging the doors.

A key hole slot 54 at the back wall 15 is provided in case it is desired to hang the cabinet from a hook or the like on a wall.

Figure 5:
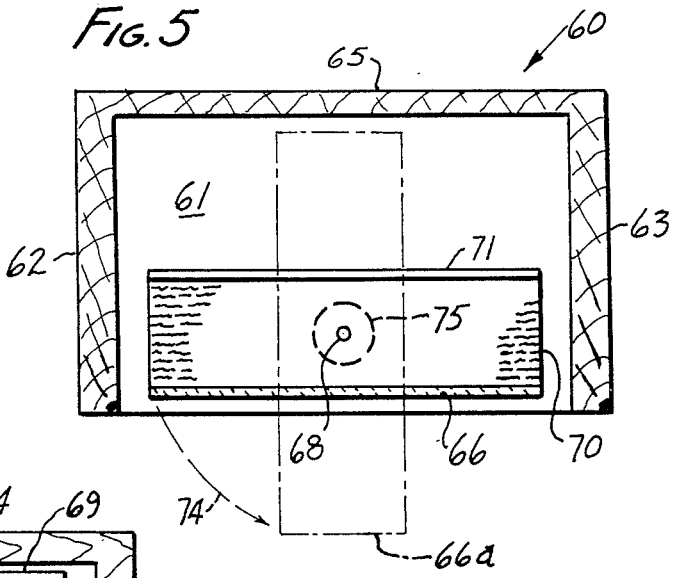
FIG. 5 is a cross-section view taken at line 5—5 of FIG. 4.
Figure 4:
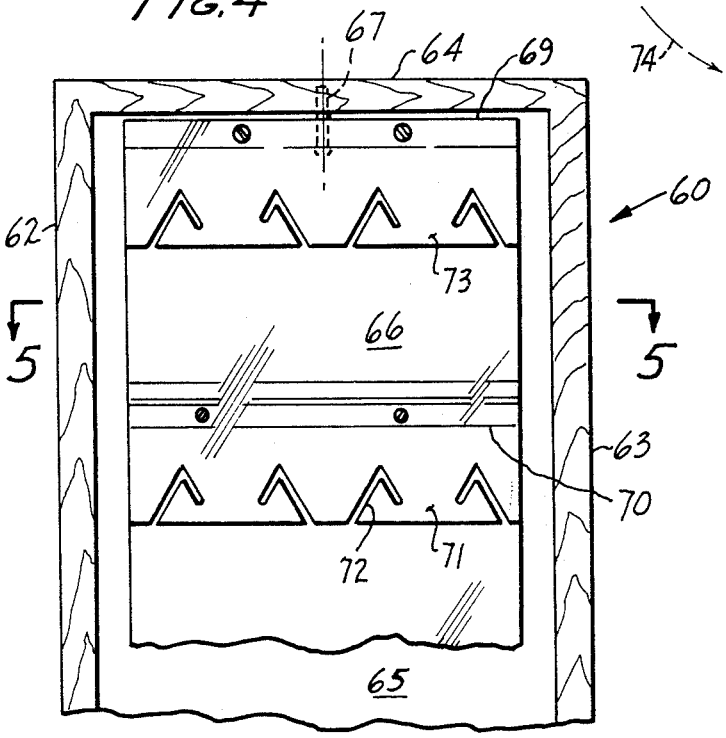
FIG. 4 is an elevation view showing a modified form of jewelry storage and display means according to this invention.

FIGS. 4 and 5 illustrate a modification of the arrangement shown in FIGS. 1 through 3. FIG. 4 shows the upper part of a cabinet 60 having a base 61, vertical sides 62 and 63 and a horizontal top 64, corresponding to the members 11, 12, 13 and 14 respectively, of FIGS. 1 through 3. There is also a back 65. The open front is covered by a single rectangular transparent panel 66 which pivots on a vertical axis at upper and lower pivot pins 67 and 68 in a manner similar to that of the upper and lower pivot pins in the embodiment of FIGS. 1 to 3. Pivot pins 67 and 68 are placed midway between the two vertical side walls 62 and 63. The panel 66 is of a width which enables it to substantially cover the front of the cabinet as shown in FIG. 5 with clearance between each side and the respective side walls 62 and 63, sufficient to permit the pivoting. The panel 66 is provided with upper and lower strips in a manner similar to that of FIGS. 1 through 3, of which only the upper strip 69 is shown. The panel also is provided with vertically spaced shelves 70 in a manner similar to the shelves of FIGS. 1 through 3. Likewise, the upper strip 69 and each of the shelves is provided at its rear edge with transparent strips 71 with inverted V-shaped slots 72 arranged in a manner similar to those of FIGS. 1 through 3; and the rear edge of the upper strip 69 likewise has attached to it a transparent strip 73 provided with similar inverted V slots in a manner similar to those of FIGS. 1 through 3. At the bottom of the lower strip there is provided a thrust washer 75 arranged similarly to the thrust washers 49 and 59 of FIGS. 1 through 3. The clearance between the ends of the shelves and the upper and lower strips is sufficient so that when the panel is pivoted to its broken line position shown in FIG. 5 at 66*a*, as indicated by arrow 74 there is room for the front and rear corners of the shelves to pass by the vertical walls 62 and 63.

It is noted that although the slots 39 and 40 are described as inverted V slots, they need not have a precise inverted V shape. The portion of the slot which is uppermost may be rounded in some way, as for example, an inverted U, or some other rounded shape. The term inverted V as used herein covers such other rounded shapes, such as an inverted U.

It will be understood that the embodiments of the invention illustrated and described herein are given by way of illustration and not of limitation, and that modifications or equivalents or alternatives within the scope of the invention suggest themselves to those skilled in the art.

I claim:

1. Means for storing jewelry comprising:

a cabinet having a base, a roof and vertical side walls, providing an opening at the front;

vertical door means at the front pivoted to swing in vertical planes so that the door means may be pivoted to a position where it is a vertical closure for the front opening and to another position where it opens to provide access to the interior of the cabinet;

shelf means attached at the rear of the door means, said shelf means having a rear edge;

strip means depending from the rear edge of the shelf means to a position below the shelf means;

said strip means containing slot means below the shelf means from which jewelry items may hang, said slot means being in the shape of an inverted V one side of which extends to the bottom of the strip means for insertion of a jewelry item and the other side of which terminates short of the bottom of the strip means to hold the jewelry item against falling from the slot means.

2. Means for storing jewelry according to claim 1 in which the strip means extends upwardly from the shelf means to prevent jewelry items on the shelf means from falling off.

3. Means according to claim 1 in which the shelf means comprises a plurality of vertically spaced horizontal shelves, and the strip means comprises a strip depending from each of said plurality of shelves, and the slot means comprises a plurality of said inverted V's.

4. Means according to claim 3 in which said strips extend vertically upward from each of a plurality of said shelves.

* * * * *